US007111957B2

(12) United States Patent
Bernhart et al.

(10) Patent No.: US 7,111,957 B2
(45) Date of Patent: Sep. 26, 2006

(54) TILT AND LOCK AIR HANDLING FIXTURE

(75) Inventors: Horst J. Bernhart, Apple Valley, CA (US); Raymond A. Campeau, Jr., Fall River, MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 181 days.

(21) Appl. No.: 10/755,764

(22) Filed: Jan. 12, 2004

(65) Prior Publication Data

US 2005/0152132 A1 Jul. 14, 2005

(51) Int. Cl.
*F24F 11/00* (2006.01)

(52) U.S. Cl. ..... 362/147; 362/96; 362/148; 362/150; 362/404

(58) Field of Classification Search ..... 362/269, 362/287, 427, 96, 149, 404, 147, 150, 419; 439/110

See application file for complete search history.

(56) References Cited

U.S. PATENT DOCUMENTS

| | | | | |
|---|---|---|---|---|
| 2,518,724 | A | 8/1950 | Runge | |
| 2,948,807 | A | 8/1960 | Maciel, Jr. et al. | |
| 2,956,150 | A | 10/1960 | Schwartz et al. | |
| 2,966,325 | A | 12/1960 | Pascucci | |
| 2,973,177 | A | 2/1961 | Stubbs | |
| 3,051,430 | A | 8/1962 | Halfaker | |
| 3,101,038 | A | 8/1963 | Archer | |
| 3,169,467 | A | 2/1965 | Archer | |
| 3,181,450 | A | 5/1965 | Kruger | |
| 3,187,360 | A | 6/1965 | Lazerson | |
| 3,348,465 | A | 10/1967 | Kruger | |
| 4,138,716 | A | 2/1979 | Muhlethaler et al. | |
| 4,238,815 | A | 12/1980 | Price | |
| 4,449,166 | A | 5/1984 | Sharp | |
| 4,729,080 | A | 3/1988 | Fremont et al. | |
| 5,452,193 | A | 9/1995 | Hinnefeld et al. | |
| 5,457,617 | A | 10/1995 | Chan et al. | |
| 5,548,499 | A | 8/1996 | Zadeh | |
| RE36,004 | E | 12/1998 | Hinnefeld et al. | |
| 6,095,669 | A | 8/2000 | Cho | |
| 6,113,245 | A | 9/2000 | Reinert, Sr. | |
| 6,170,967 | B1 * | 1/2001 | Usher et al. | 362/394 |
| 6,517,222 | B1 | 2/2003 | Orlov | |
| 6,746,325 | B1 * | 6/2004 | Crane | 454/342 |
| 2002/0154502 | A1 | 10/2002 | Kelmelis et al. | |

* cited by examiner

*Primary Examiner*—Sandra O'Shea
*Assistant Examiner*—Anabel Ton
(74) *Attorney, Agent, or Firm*—James E. Cole; Middleton Reutlinger

(57) ABSTRACT

According to the invention, an air handling fixture is provided which can be tilted and locked at a preselected angle when mounted on a sloped ceiling so that a depending pendant tracklight is plumb or perpendicular to a horizontal floor there beneath. The fixture comprises an air handling channel including a plurality of air handling slots, a tilt and lock mechanism, the tilt and lock mechanism having an upper portion, including a toggle lock and casing, and a lower portion, including at least a light retaining component slidably adjustable through a preselected arc.

28 Claims, 8 Drawing Sheets

TILT AND LOCK AIR HANDLING FIXTURE

FIELD OF THE INVENTION

The present invention relates to a light fixture for track and fluorescent lighting. More particularly, the present invention relates to a pendant track lighting fixture for use with a recessed air handling channel allowing for air handling and tilting and locking of the fixture at a preselected angle to compensate for a sloped ceiling.

BACKGROUND OF THE INVENTION

When mounting a track type pendant light fixture on a sloped ceiling, the pendant arm depending from the fixture will be positioned at an angle to a horizontal floor there beneath. A problem exists because prior art fixtures fail to provide adjustment so that the pendant arm is perpendicular to a horizontal floor or plumb.

Given the foregoing deficiencies, it will be appreciated that a light fixture is needed which is adjustable to a preselected angle and lockable such that pendant-track type lighting can hang perpendicular to a floor beneath said lighting.

SUMMARY OF THE INVENTION

With regard to the foregoing, the present invention eliminates the oversights, difficulties, and disadvantages of the prior art by providing a tilt and lock air handling light fixture.

An object of the present is to provide an air handling light fixture.

An additional object of the present invention is to provide an air handling light fixture for use with either track lighting or a fluorescent fixture.

Another object of the present invention is to provide an air handling fixture which can be mounted on a sloped ceiling and from which pendant lights depend yet remain plumb with a horizontal floor beneath.

Yet another object of the present invention is to provide a tilt and lock mechanism within the fixture allowing tilting to a preselected angle and locking of the fixture in the preselected position.

According to the invention, an air handling fixture is provided which can be tilted and locked at a preselected angle when mounted on a sloped ceiling so that a depending pendant tracklight is plumb or perpendicular to a horizontal floor there beneath. The fixture comprises an air handling channel including a plurality of air handling slots, a tilt and lock mechanism, the tilt and lock mechanism having an upper portion, including a toggle lock and casing, and a lower portion, including at least a light retaining component slidably adjustable through a preselected arc. The lower portion may also include a light retaining component including a trackhead and a plurality of conductive strips. The fixture may include a tracklight depending from the fixture wherein the tracklight is a pendant light. Alternatively, the lower portion may have a ballast and at least one fluorescent lamp.

DETAILED DESCRIPTION OF THE PREFERRED EMBODIMENTS

Referring now in detail to the drawings, wherein like numerals indicate like elements throughout the several views, there are shown in FIGS. 1 through 12 various aspects of a tilt and lock air handling fixture. The tilt and lock air handling fixture may be used with track pendant lighting in sloped ceilings to provide air handling capabilities. In addition, the fixture is adjustable within an air handling channel so that when the pendant lighting depends from the sloped ceiling, the lighting is perpendicular to the floor there below. The present invention provides a light fixture for use with a fluorescent or discharge lamp.

The present invention provides a fixture which is positioned within a sloped ceiling wherein an air handling plenum is in fluid communication with the fixture. In addition to air handling capability, it is desirable to provide adjustment of the fixture so that a pendant arm depends from a sloped or angled ceiling while being plumb or perpendicular to a horizontal floor beneath.

Figure 1:
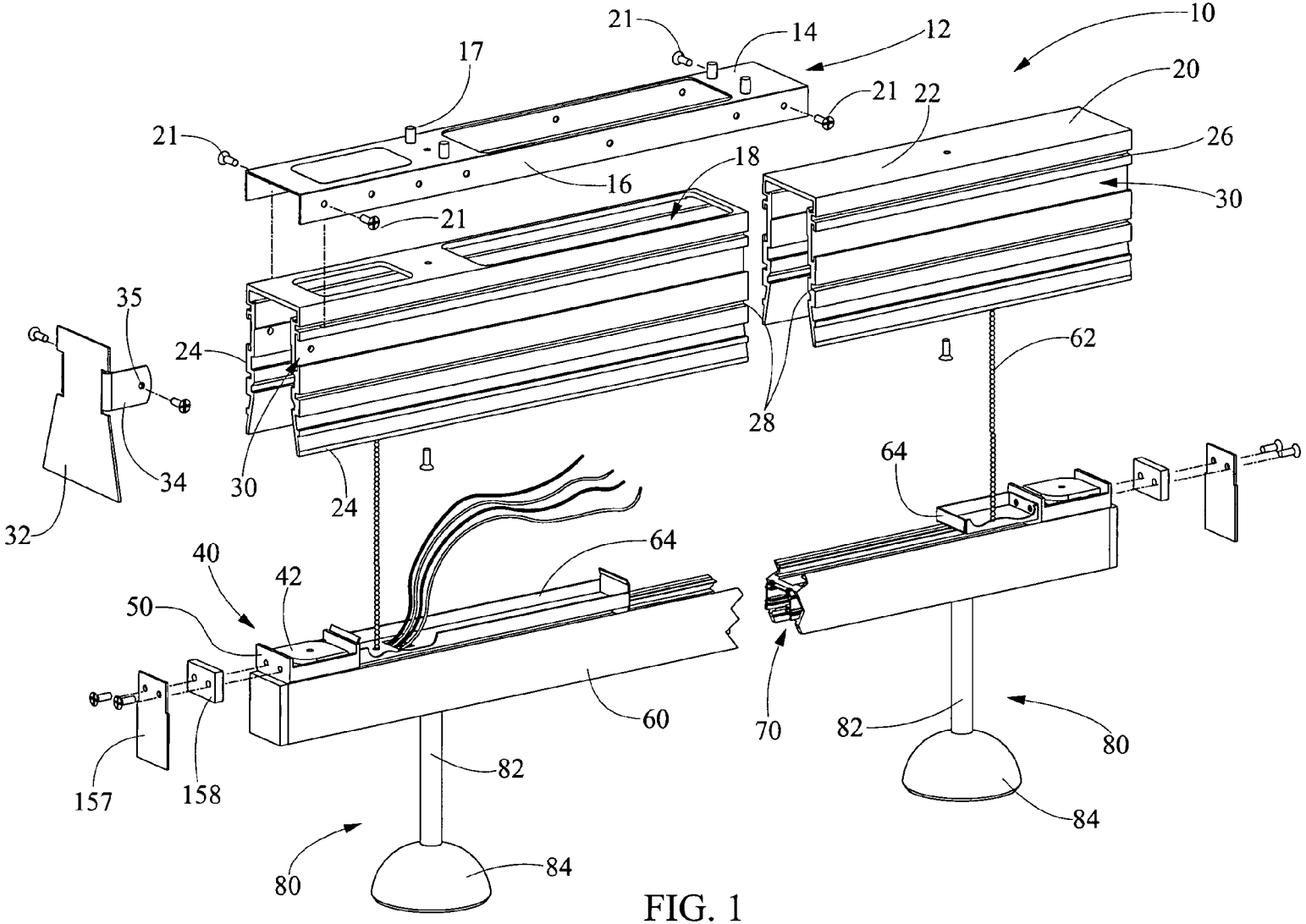
FIG. 1 is an exploded perspective view of the tilt and lock air handling fixture of the present invention.

Referring initially to FIG. 1, an exploded assembly view of the tilt and lock air handling light fixture 10 is shown. Generally, the fixture 10 includes a cover 12, an air handling channel 20, a tilt and lock mechanism 40, a linear extrusion or light retaining component 60, and a pendant track light 80 defined by a pendant arm 82 and reflector 84.

Figure 2:
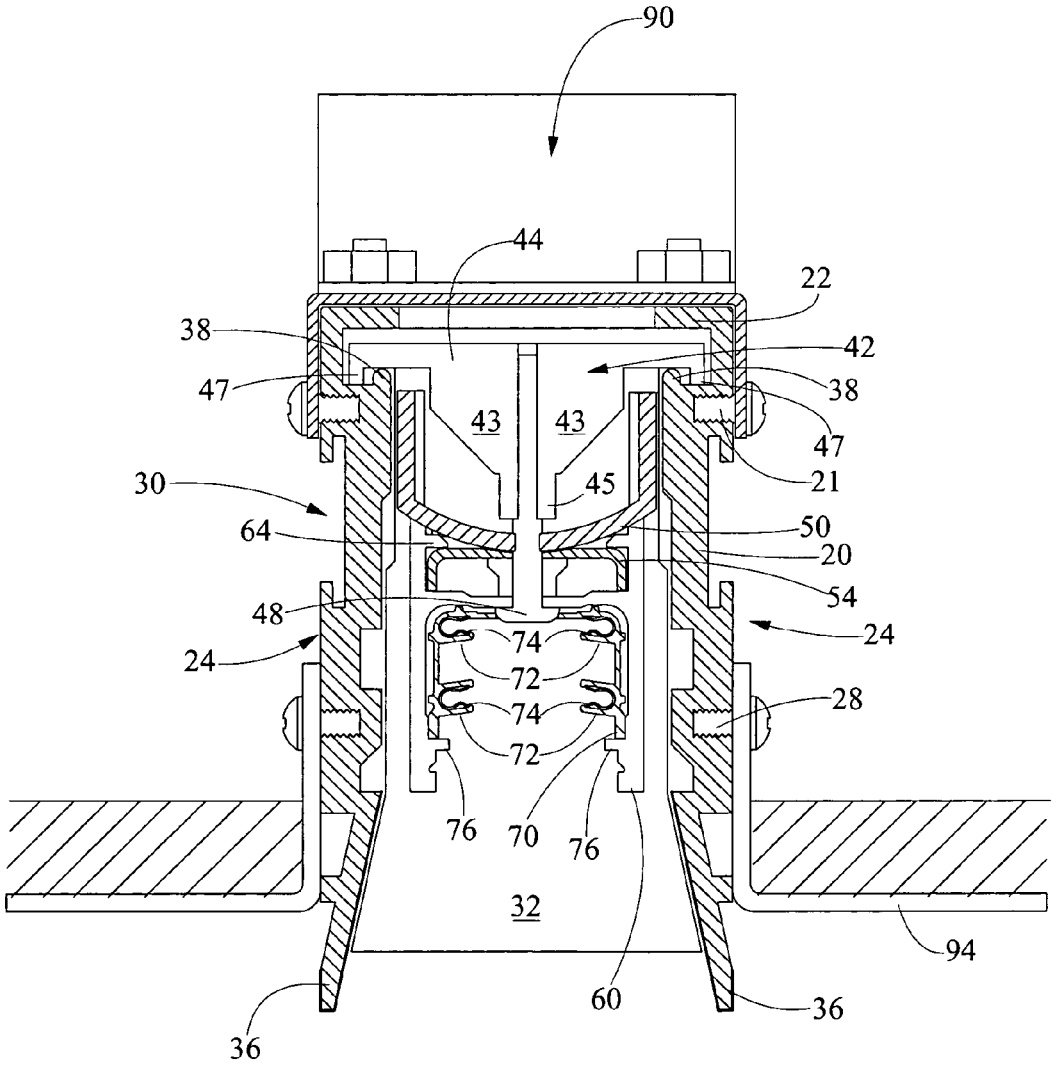
FIG. 2 is a sectional view of an assembled tilt and lock air handling fixture of FIG. 1.
Figure 3:
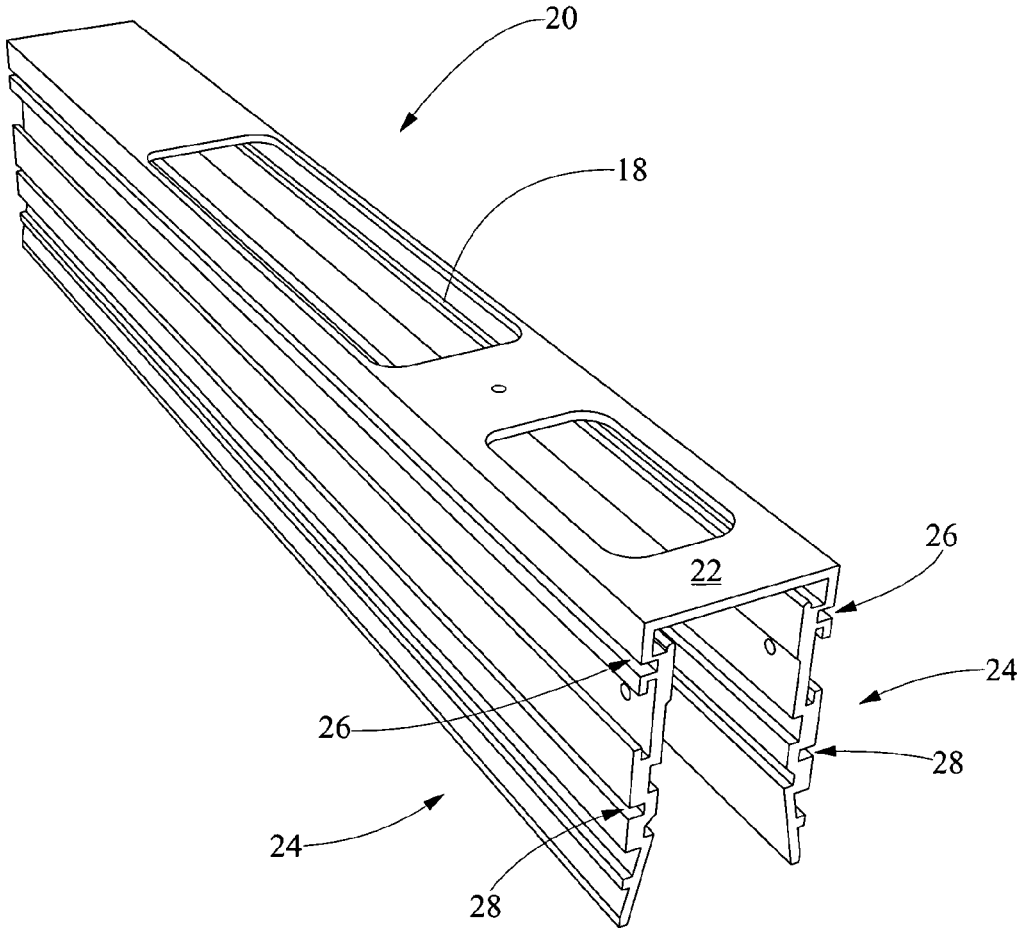
FIG. 3 is a perspective view of an air-handling channel with air return slots of the fixture of FIG. 1.

Referring now to FIGS. 1 and 2, the cover 12 is substantially U-shaped having a first upper surface 14 and two adjacent fastening surfaces 16. The cover 12 functions to cover air return slots 18 in the channel 20 so that return air is directed only through the desired slots in the channel 20. Extending from an upper surface 14 of the cover 12 are fasteners 17 for attaching a junction box 90 (FIG. 2) wherein wire splices may be located in order to provide electrical communication with a power source (not shown). The cover 12 should include at least one aperture wherein wires may extend through to the junction box 90 for providing electrical communication to a lamp.

Within the cover fastening surfaces 16 are a plurality of fastening apertures 19. The fastening apertures 19 receive threaded fasteners 21 which extend through the surfaces 16 and into the channel 20 in order to retain the cover 12 on the channel 20 over air return slots 18.

Referring now to FIGS. 1–4, the air handling channel 20 is shown located beneath and fastened to the cover 12. The air handling channel 20 comprises three sides, an upper surface 22 and two opposed depending sides 24 which define the channel shape. The channel 20 functions to house a linear extrusion 60 and tilt and lock mechanism 40 therein.

The channel upper surface 22 also defines a plurality of air slots 18 where upon the cover 12 may be positioned over any of the air slots 18 in order to direct return air to a desired plenum above the fixture 10. The channel sides 24 each have an upper extruded groove 26 and a lower extruded groove 28. The upper groove 26 has a plurality of ridges for receiving a threaded fastener. As the Figures depict, the upper groove 26 receives a fastener 21 so that the cover 12 may be attached to the channel 20 as previously described. The extruded upper groove 26 allows the cover 12 to be fastened at any location along the length of the channel 20. The lower extruded groove 28, as best seen in FIG. 2, allows connection of ceiling brackets 94 which are substantially L-shaped and extend the length of the channel 20 in order to support portions of ceiling tile which abut the fixture 10. Like the cover 12, the brackets 94 may be fastened to the channel 20 at any point along the length of the channel 20 since the lower extruded groove 28 extends the length of the channel 20. As one of ordinary skill in the art should understand from FIG. 2, a majority of the fixture 10 is positioned above ceiling level and therefore the tilt function of the present invention should be provided within the channel 20 and partially above ceiling level.

Also positioned along the sides 24 of the channel 20 is a spline area 30 which receives a spline or tab 34 extending from end cap 32. The end cap 32 may positioned at one or both ends of the channel 20 and is fastened through an aperture 35 in each tab 34 and through an aperture in each spline area 30. The end cap 32 functions to close the end of the channel 20 and inhibit exposure of parts therein which could posed an electrical shock hazard or mechanical pinching areas. Further the end caps 32 help direct air flow through the fixture 10.

At lower portions of each channel side 24 are angled wall portions 36 best shown in FIG. 2. In this illustrative embodiment, the angled wall portions 36 are angled such that the linear extrusion 60 and any lighting components depending therefrom may depend at an angle of about five (5) degrees from an imaginary vertical line. However, various angles may be substituted depending on the amount of arcuate motion desired for the lighting and slope of the ceiling wherein the fixture 10 is positioned.

As shown in FIG. 2, within an upper portion of the channel 20 and spaced a distance from the channel upper surface 22 are upwardly extending protrusions 38 which are positioned to allow locking engagement of the tilt and lock mechanism 40. The tilt and lock mechanism 40 includes an upper portion comprising a toggle lock 42, a casing 50, and a fastener 48. A lower portion of the tilt and lock mechanism 40 comprises an adapter 54, the linear extrusion or light retaining component 60 having a trackhead therein, and a track light 80 which move through a preselected arcuate path, for instance about ten (10) degrees or five (5) degrees in two directions from the vertical. In other words, the lower portion moves relative to the upper portion of the tilt and lock mechanism 40.

Referring now to FIGS. 1–2 and 4–8, the toggle lock 42 is substantially T-shaped defined by an upper plate 44 and a fastener receiving portion 45 depending from the plate 44 defining the substantially T-shape. The toggle lock 42 may also include strengthening flanges 43 extending between the upper plate 44 and the fastener receiving portion 45. The upper plate 44 and fastener receiving portion 45 pivot about fastener 48 which is threadably inserted into the portion 45. The thread receiving portion 45 further includes an insert (not shown) which creates a preselected amount of friction between the fastener 48 and thread receiving portion 45 as the fastener is inserted into the receiving portion a preselected distance. The insert may be formed of, for instance, rubber or plastic and the insert also functions to cause the toggle lock 42 to turn as the fastener 48 is turned after the fastener is inserted into the receiving portion a preselected distance. The upper plate 44 is substantially rectangular in shape so that it is wider in one dimension than a second dimension.

Figure 4:
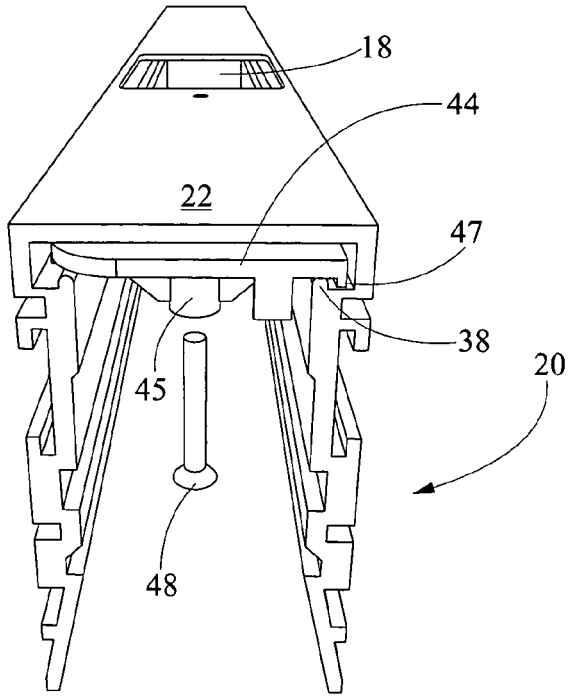
FIG. 4 is a perspective end view of the channel of FIG. 3 with a toggle lock shown in a locked position.
Figure 5:
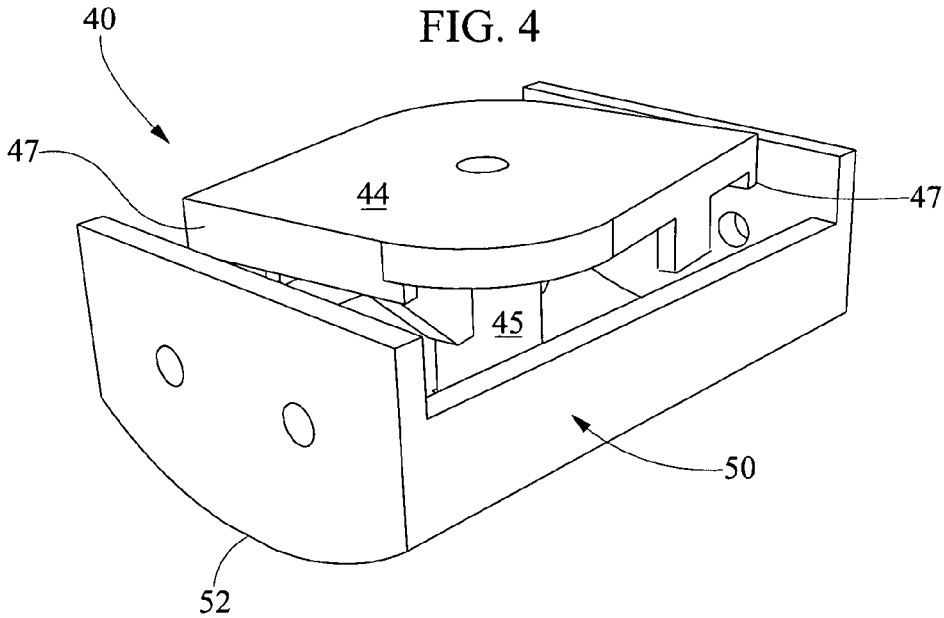
FIG. 5 is a perspective view of the toggle lock and casing of the present invention.
Figure 7:
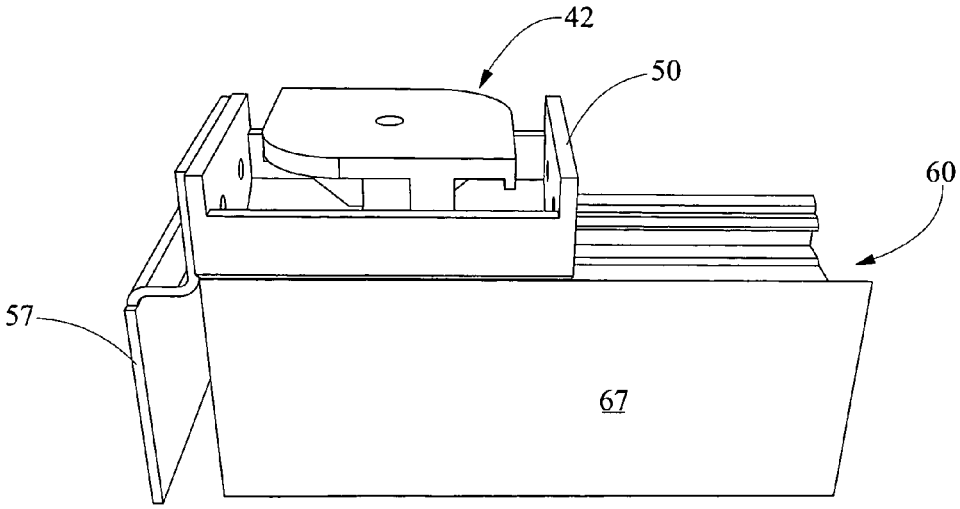
FIG. 7 is a side perspective view of the toggle lock and casing mounted to a linear extrusion with the toggle lock shown in a disengaged position.
Figure 8:
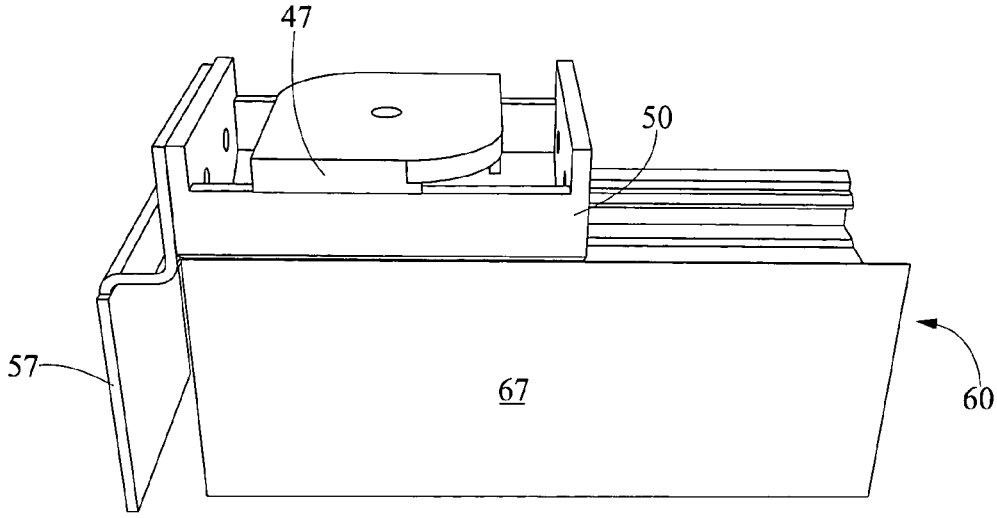
FIG. 8 is a side perspective view of the toggle lock and casing of FIG. 7 with the toggle lock shown in an engaged position.

At first and second diagonally opposed end of the upper plate 44, there are located downwardly depending fingers 47 which are positioned beyond the protrusions 38 as best seen in FIGS. 2, 4, and 8. Alternate diagonally opposed corners of plate 44 have radiused corners allowing the plate 44 to rotate past casing endwalls as described further hereinafter. Referring now to FIGS. 5 and 7, the toggle lock 42 is shown in a disengaged position wherein the upper plate 44 is not wider than the casing 50. In these views, the upper plate is shown within the bounds of the sidewalls of casing 50. In other words, since the fingers 47 are disposed within the bounds of a casing 50 the fingers 47 cannot engage the protrusions 38 of channel 20. In this position, the fingers 47 are located about ninety (90) degrees from their position shown in FIGS. 2 and 4 and therefore are unlocked with respect to the channel 20. Alternatively, when the plate 44 is rotated as shown in FIGS. 2,4, and 8, the fingers 47 extend outwardly beyond the protrusions 38 to lock the tilt and lock mechanism 40 within the channel 20. This is done to the rectangular shape of the upper plate being wider than the casing 50 when disposed as shown in FIGS. 2,4, and 8. In order to properly function, two corners of the plate 44 must be radiused to allow the corners to pass by the endwalls of the casing 50.

Referring now to FIG. 2, 5-6 and 9-10, the casing 50 is shown defining an additional portion of the tilt and lock mechanism 40. The casing 50 has four sides including opposed sidewalls and opposed endwalls for attachment of an end cap as well as a lower curvilinear or camming surface 52. The top of the casing 50 is open wherein the toggle lock 42 is rotatably positioned. The upper open area of the casing 50 is substantially rectangular in shape and the plate 44 is slightly smaller than the opening of the casing 50. In order to allow for rotation of the substantially rectangular plate 44 within the rectangular opening of the casing 50, diagonally opposed corners of the plate 44 are radiused to inhibit contact with the casing end walls. The sidewalls of casing 50 are shorter in height than the endwalls so that the upper plate 44 can extend beyond the sidewalls into the locked position.

Figure 6:
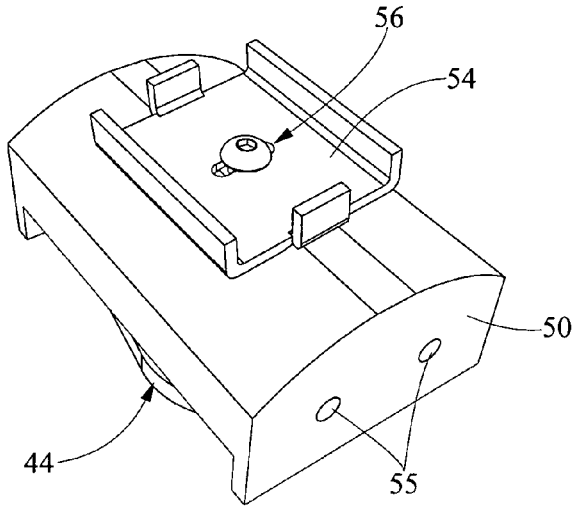
FIG. 6 is a lower perspective view of the toggle lock, casing, and adapter of FIG. 5.

Referring now to FIGS. 2,5, and 6, the lower curvilinear surface 52 of the casing 50 allows the arcuate motion of the light retaining component 60 or otherwise described, provides for the tilting of the lighting component in combination with an adapter 54. The adapter 54, shown in FIGS. 2 and 6, is substantially U-shaped and fits within a portion of the linear extrusion 60. As seen in FIG. 6, the adapter 54 has a central oblong aperture 56 through which the fastener 48 extends. The oblong aperture 56 allows the adapter to move relative to the fastener 48 in the direction of a major axis of the oblong aperture 56 until the fastener is tightened to retain the adapter 54 against casing surface 52. As shown in FIGS.

6 and 7, the casing 50 also comprises first and second apertures 55 for attaching an end plate 57. The end plate 57 inhibits interference between the casing 50 and adapter 54, as well as inhibiting contact with the electrical components within the linear extrusion 60. As shown in FIG. 7, an end plate 57 is depicted wherein a spacer is not required because the plate includes a curve to extend outwardly. Alternatively, the end plate 157 shown in FIG. 1 is a flat plate with at least one fastener aperture. A spacer 158 provides a means for connection to between the end plate 157 and casing 50.

Figure 9:
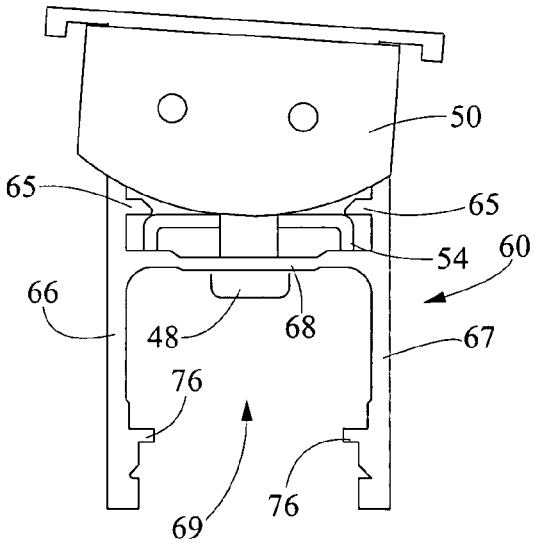
FIG. 9 is an end view of the linear extrusion and casing in a first angled position.
Figure 10:
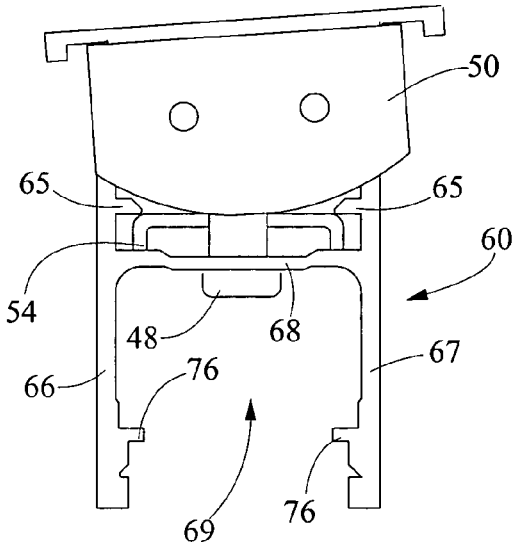
FIG. 10 is an end view of the linear extrusion and casing in a second angled position.

Referring now to FIGS. 9 and 10, the tilt and lock mechanism 40 is shown in side views tilted in a first position and a second position. When the fastener 48 is loosened such that the adapter 54 can be moved to the left, the linear extrusion 60 may be tilted through a preselected arc from a centerline extending through the casing 50, as shown in FIG. 9. Alternatively, when the adapter 54 is moved to the right, the linear extrusion 60 and related lighting components will be tilted through a preselected arc from the center of the casing 50 in the opposite direction. The tilting feature allows the fixture 10 to be mounted within a sloped ceiling and with a pendant arm 82 (FIG. 1) depending therefrom. The titling feature maintains the pendant arm 82 (FIG. 1) in a perpendicular orientation with respect to a horizontal floor there beneath.

As shown in FIG. 2, with the toggle lock 42 in the engaged position, the linear extrusion 60 is housed within the channel 20. As seen in FIG. 1, when the toggle lock 42 is in the disengaged position, the linear extrusion 60 can be lowered from the channel 20 and is supported by a retaining chain 62. The retaining chain 62 may be stored in a tray 64 located in on an upper surface of the linear extrusion 60.

Referring now to FIGS. 2 and 9–10, the linear extrusion or light retaining component 60 includes parallel first and second vertical portions 66,67 and a horizontal portion 68, defining a substantially H-shaped structure. Within the upper portion of the light retaining component 60 are opposed beads 65 for retaining the adapter 54 in place. As previously indicated as the adapter 54 moves along the lower curvilinear surface 52 of the casing. 50, the adapter 54 is disposed at some angle to an imaginary vertical centerline extending through the casing 50. As a result, the linear extrusion 60 is also displaced at the angle of the adapter 54 relative to the casing 50. The fastener 48 extends through the horizontal portion 68 and is retained by a fastener head against an undersurface of the horizontal portion 68 while extending through the adapter 54, the casing 50, and into the toggle lock fastener receiving portion 45.

As seen in FIGS. 9 and 10, the vertical portions 66,67 and the horizontal portion 68 also define a cavity 69 beneath the horizontal portion 68. Referring now to FIGS. 1 and 2, a trackhead 70 is shown disposed within the cavity 69. The trackhead 70 may be a molded part formed of some material having insulating or non-conductive characteristics. The trackhead 70 includes a plurality of tracks 72 extending the length of the trackhead 70 and linear extrusion 60. Within the tracks 72 are conductive strips 74 for receiving a slidable track lighting, preferably a pendant light fixture. Thus the trackhead 70, tracks 72 and conductive strips 74 provide the structure to move the lighting through the length of the channel 20. Extending inwardly from the vertical portions 67 are retaining beads 76 which retain the trackhead 72 in position within the linear extrusion cavity 69.

Figure 11:
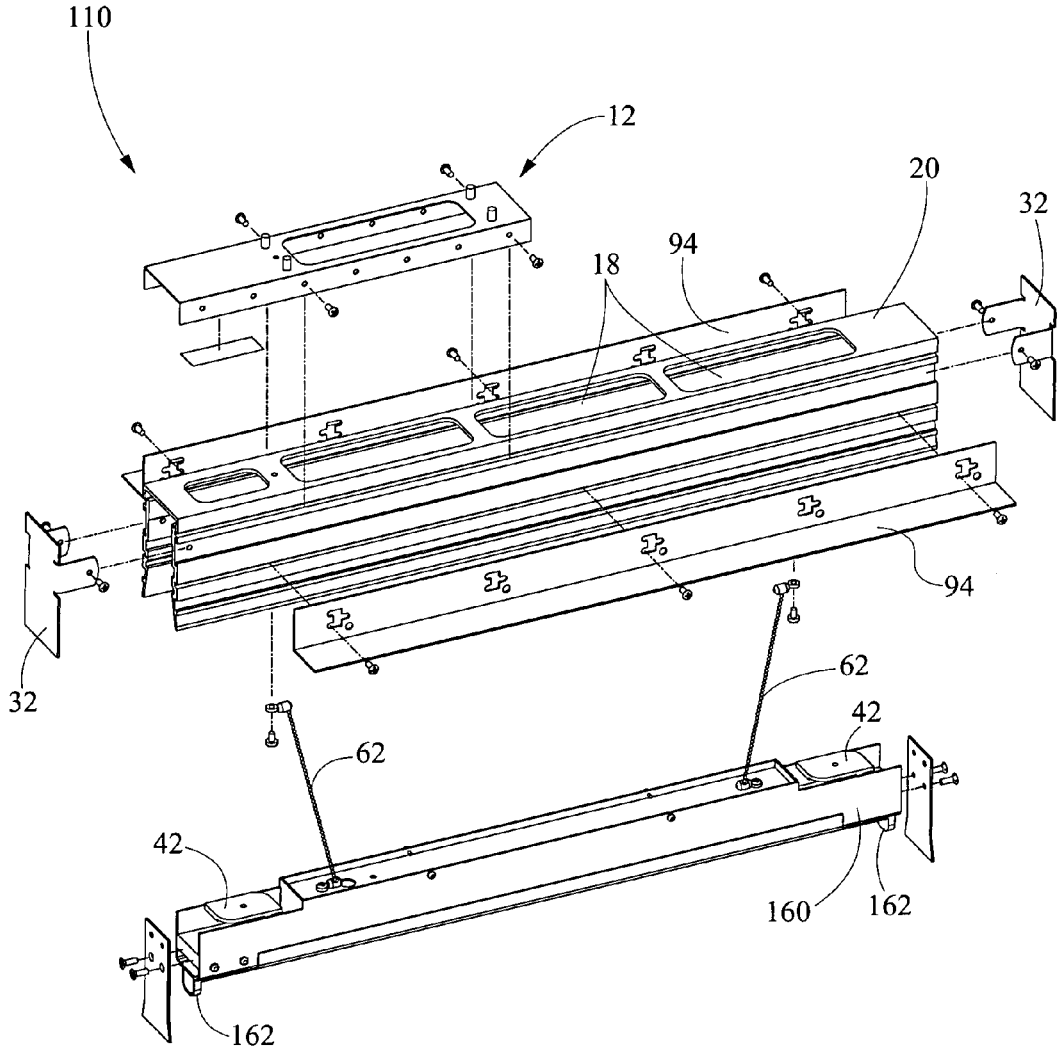
FIG. 11 is an exploded perspective view of a tilt and lock air handling fixture of the present invention shown adapted for use with fluorescent lamps; and, FIG. 12 is a sectional view of the fixture with an angular adjustment tool disposed therein.

Referring now to FIG. 11, an alternative tilt and lock air handling fixture 110 is depicted. Fixture 110 is shown for use with a fluorescent lamp and comprises similar parts to the fixture 10 shown in FIG. 1. The fixture 110 includes a cover 12 positioned above a channel 20 wherein one or more air slots 18 may be located along an upper surface 22 of the channel. The channel 20 may also have ceiling mounting brackets 94 fastened to opposed sides of the channel 20. End caps 32 are fastened to ends of the channel 20 in order to inhibit contact with mechanical or electrical parts housed therein as well as direct air flow. Connected along an upper surface 22 of the channel 20 are retaining chains 62 which are connected to the channel 20 at a first end and to a fluorescent fixture 160 at a second end. The fluorescent fixture 160 may include a ballast (not shown) mounted therein for providing necessary electrical conditions to cause an arc between the electrodes 162. Positioned at ends of the fluorescent fixture 160 along upper portions, are toggle locks 42 which are shown in the disengaged position. However, by rotating the toggle locks 42 about 90 in a counterclockwise direction, the locks 42 are moved to an engaged position locking the fluorescent fixture 160 within the channel 20. The previously described casings 50 are not shown in conjunction with the toggle locks 42 since the tilt function is not as important with fluorescent lamp usage. However if the tilt function is desired for use with the present invention, a casing 50 and adapter 54 may be attached to the fluorescent fixture 160. At opposed ends of the fluorescent fixture 160 are electrode connections 162 which receive electrodes extending from a discharge lamp. The fixture 160 may also have fixture caps 164 fastened to the fixture 160 which inhibit contact with electrical components within the fixture 160.

Figure 12:
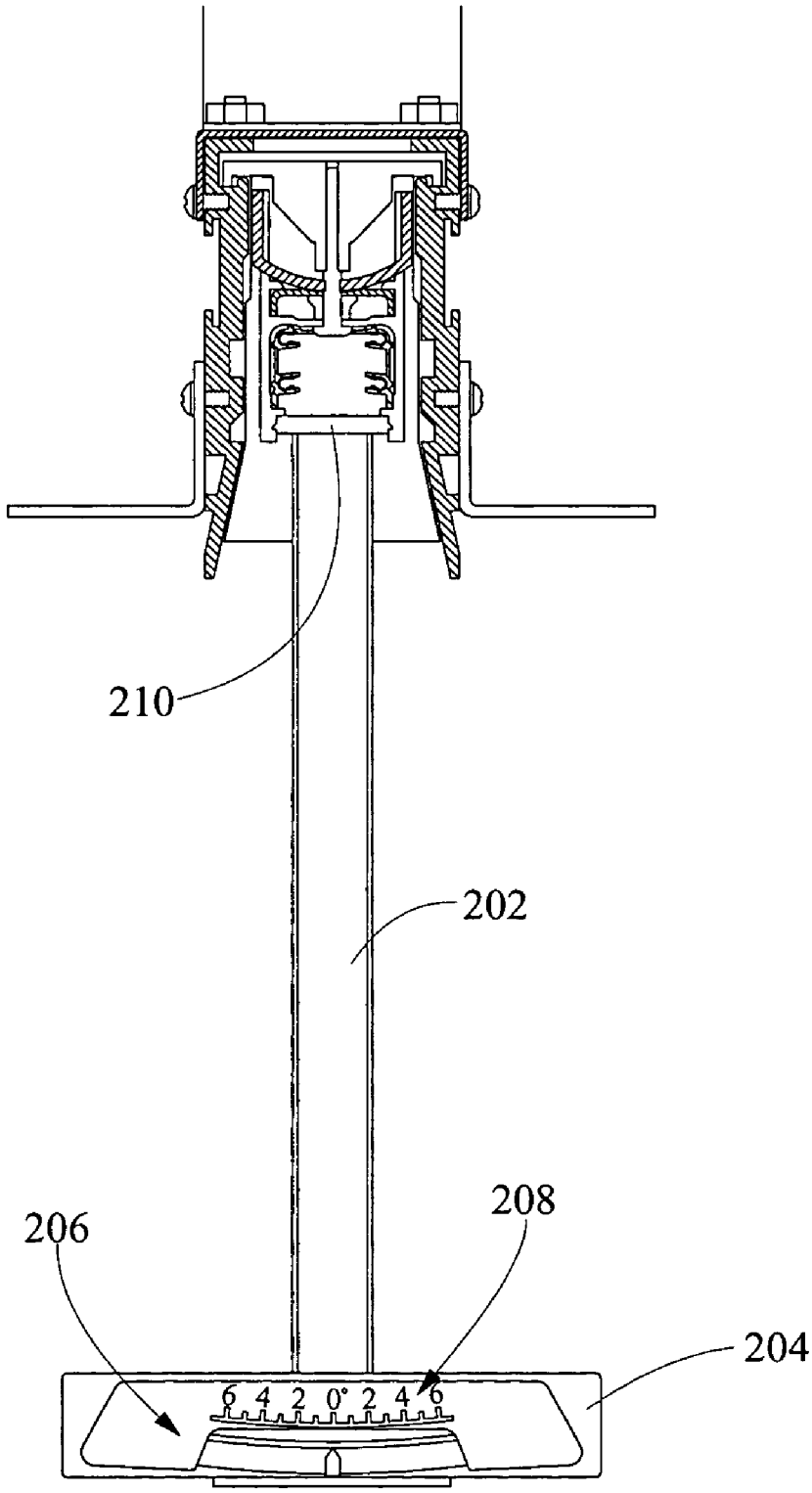

Referring now to FIG. 12, a measurement tool 200 is shown for setting the tilt angle of the linear extrusion. The tool 200 has a first vertical leg 202 extending substantially perpendicularly from a central portion of a second horizontal leg or handle 204. The second horizontal leg or handle 204 has a level with a bubble indicator 206 comprising a liquid and air bubble therein. The liquid may be colored to provide increased contrast with the air bubble for ease of reading. The outer finish of the handle 204 includes a plurality of indicia 208 in order providing markings against which the air bubble of the bubble level indicator 206 are read to indicate the angle of the trackhead 70 and linear extrusion 60. More importantly, the bubble indicator 206 indicates when the depending pendant arm is plumb with the horizontal floor beneath. At a distal end of the first leg 202 is a plate or engagement portion 210 which is positioned within the linear extrusion 60. More specifically, the linear extrusion 60 of the illustrative embodiment includes the opposed extruded rib or retaining bead 76. The plate 210 is positioned against the retaining beads 76 so that the plate 210 is flush with the retaining beads 76 and the long leg 202 extends from the linear extrusion 60 at the same angle from the vertical as the linear extrusion 60. Since the retaining beads 76 extend the entire length of the linear extrusion 60 the measurement tool 200 may be positioned in various positions along the length of the linear extrusion 60. When the plate 210 is positioned so that fastener 48 can be loosened, the measurement tool 200 may be adjusted by moving the handle 204. As the handle 204 is moved, the linear extrusion 60 moves as shown by the bubble indicator 206. Once the desired angle is reached the fastener 48 may be tightened.

In operation, the tilt and lock fixture 10 is intended for use with a sloped ceiling wherein a pendant track light 80 is depending from the fixture and air handling is desired. However, the fixture described herein may alternatively be mounted within a flat ceiling wherein air handling capability is desired. Normally the pendant arm 82 would be positioned at an angle to the floor because of the ceiling slope. However, the tilting motion of the linear extrusion 60 within the air-handling channel 20 allows the pendant arm 82 to depend from the fixture 10 and be perpendicular to a horizontal floor beneath. The junction box 90 is fastened to the channel 20 utilizing the junction box fasteners 17. Wiring extending from the conductors 74 or a ballast (not shown) is spliced within the junction box 90 while the linear extrusion 60 depends from the channel 20 and is supported by the retaining chains 62. Next, the linear extrusion 60 is inserted into the channel 20 and the toggle lock 42 is turned by rotation of the fastener 48 such that the curved corners of the upper plate 44 are urged by the channel sides 24 and the upper plate fingers 47 are rotated beyond the protrusions 38. This motion locks the linear extrusion 60 in place within the channel 20. Next, the ceiling mounting brackets 94 are fastened to the channel 20 and ceiling tiles are positioned to abut the channel 20 on the mounting brackets 94. The fastener 48 is loosened and the measurement tool 200 is positioned within linear extrusion 60. An installer may read the measurement tool 200 and by knowing the slope of the floor the angle of the linear extrusion 60 may be adjusted to offset the ceiling angle such that the pendant arm 82 will depend from the trackhead 70 and be plumb with a horizontal floor beneath.

It is apparent that variations may be made to the screening machine design of the present invention in regards to specific design elements thereof. Such variations however are deemed to fall within the teachings of the present invention as generally modifications may be made to placement of the particular structure described herein while falling within the general teachings hereof.

We claim:

1. A tilt and lock air handling light fixture, comprising:
a channel having at least one air handling slot located in an upper surface of said channel;
a casing disposed within said channel having a substantially curvilinear lower surface;
a linear extrusion abutting said curvilinear lower surface and slidably adjustable along said curvilinear lower surface.

2. The tilt and lock air handling light fixture of claim 1, said channel having a protrusion on a vertical wall beneath said upper surface of said channel.

3. The tilt and lock air handling light fixture of claim 2 further comprising a toggle lock having an upper portion spaced between said protrusion and said upper surface.

4. The tilt and lock air handling light fixture of claim 3, said toggle lock having a lower portion positioned within said casing.

5. The tilt and lock air handling light fixture of claim 3 further comprising a fastener extending upwardly through said linear extrusion, said casing and said toggle lock.

6. The tilt and lock air handling light fixture of claim 5 further comprising an adapter slidably disposed between said casing curvilinear surface and said linear extrusion.

7. The tilt and lock air handling light fixture of claim 1 further comprising a cover extending at least along an upper surface of said channel.

8. The tilt and lock air handling light fixture of claim 1 further comprising ceiling brackets fastened to sides of said channel.

9. The tilt and lock air handling light fixture of claim 1 further comprising a trackhead positioned within and extending through said linear extrusion.

10. The tilt and lock air handling light fixture of claim 9, further comprising a plurality of conductive strips extending through said trackhead.

11. The tilt and lock air handling light fixture of claim 1, further comprising a retaining chain depending from said channel and connected to a chain tray positioned along an upper surface said linear extrusion.

12. A tilt and lock air handling light fixture, comprising:
a channel housing a tilt and lock mechanism;
said tilt and lock mechanism having an upper portion and a lower portion, said lower portion being slidably adjustable through a preselected arc within said channel;
said channel having a plurality of air handling slots.

13. The tilt and lock air handling light fixture of claim 12, said lower portion comprising a trackhead and a plurality of conductive strips.

14. The tilt and lock air handling light fixture of claim 13 further comprising a tracklight depending from said trackhead.

15. The tilt and lock air handling light fixture of claim 14, said tracklight being a pendant light.

16. The tilt and lock air handling light fixture of claim 12, said lower portion comprising a ballast and at least one fluorescent lamp.

17. A tilt and lock air handling light fixture, comprising:
an air handling channel having first and second retaining beads spaced beneath an upper surface of said channel;
a casing having a curvilinear lower surface suspended within said air handling channel;
at least one light retaining component slidably abutting said curvilinear lower surface of said casing and being adjustable through an arcuate path.

18. The tilt and lock air handling light fixture of claim 17, further comprising a toggle lock depending from protrusions within said channel and fastened above said light retaining component.

19. The tilt and lock air handling light fixture of claim 18, said toggle lock having an upper portion with first and second radiused diagonally opposed corners.

20. The tilt and lock air handling light fixture of claim 19, said upper portion of said toggle lock having first and second diagonally opposed fingers.

21. The tilt and lock air handling light fixture of claim 18, said toggle lock having a lower portion, said lower portion comprising strengthening flanges and a fastener receiving portion.

22. The tilt and lock air handling light fixture of claim 17 further comprising a fastener extending through said casing and a toggle lock.

23. The tilt and lock air handling light fixture of claim 21 further comprising an adapter disposed between said at least one light retaining component and said casing.

24. The tilt and lock air handling light fixture of claim 23, said adapter having a central oblong aperture, a fastener extending through said central oblong aperture and providing controlled arcuate motion along said curvilinear lower surface of said casing.

25. The tilt and lock air handling light fixture of claim 17, said light retaining component having a cavity.

26. The tilt and lock air handling light fixture of claim 25 further comprising a trackhead positioned in said cavity.

27. The tilt and lock air handling light fixture of claim 26, said trackhead having a plurality of conductive strips.

28. A tilt and lock air handling light fixture in combination with an angular adjustment tool, comprising:
a light fixture for a pendant tracklight having:
an air handling channel;
a tilt and lock mechanism;
a light retaining component; and,
an angular measurement tool having:
at least one leg;
an engagement portion extending from said at least one leg;
an angular measuring indicator.

* * * * *